United States Patent [19]

Grass

[11] Patent Number: 4,862,556

[45] Date of Patent: Sep. 5, 1989

[54] ADJUSTABLE BASE PLATE FOR HINGES

[75] Inventor: Alfred Grass, Höchst, Austria

[73] Assignee: Alfred Grass Ges.m.b.H. Metallwarenfabrik, Hochst/Vlbg., Austria

[21] Appl. No.: 197,617

[22] Filed: May 23, 1988

[30] Foreign Application Priority Data

May 22, 1987 [DE] Fed. Rep. of Germany ..... 3717376

[51] Int. Cl.[4] ..... E05D 5/00

[52] U.S. Cl. ..... 16/382; 16/383; 16/DIG. 43; 411/42

[58] Field of Search ..... 16/222, 382, 383, DIG. 43; 411/39, 40, 42

[56] References Cited

U.S. PATENT DOCUMENTS

| | | | |
|---|---|---|---|
| 1,476,836 | 12/1923 | Pleister | 411/39 |
| 4,143,579 | 3/1979 | Ziaylek, Jr. | 411/42 |
| 4,188,685 | 2/1980 | Rock et al. | 16/383 |
| 4,642,846 | 2/1987 | Lautenschlager | 16/382 |

FOREIGN PATENT DOCUMENTS

| | | |
|---|---|---|
| 2149502 | 4/1973 | Fed. Rep. of Germany . |
| 348892 | 3/1979 | Fed. Rep. of Germany . |

*Primary Examiner*—Nicholas P. Godici
*Assistant Examiner*—William Scott Andes

[57] ABSTRACT

An adjustable base plate for fastening a hinge to a furniture part embodies a base plate having at least one fastening hole therein for receiving an insert which is displaceable in the lengthwise direction of the fastening hole. The insert has a center hole of a pre-determined diameter along the longitudinal axis of the insert adapted to receive a threaded fastening screw. The fastening screw has a collar of a pre-determined diameter which is smaller than the diameter of the center hole in the area of the fastening hole of the base plate. The insert has a top part for engagement in the fastening hole of the base plate and a bottom part joined to the top part by a breakable connection adaptable to be broken by the threads of the fastening screw. The bottom part is adapted to be inserted in a hole in the furniture part and to expand into frictional engagement with the side walls of the hole in the furniture part upon insertion of the fastening screw.

5 Claims, 2 Drawing Sheets

ADJUSTABLE BASE PLATE FOR HINGES

The invention relates to an adjustable base plate for hinges as described in the classifying portion of patent claim 1. This type of base plate was made known, for example, with the subject matter of AT 348 892 C1. This known base plate requires specially designed fastening screws with a diameter along a top portion of the bolt that is smaller than the diameter of the fastening hole, the length of this portion being at least that of the fastening hole and, moreover, an external thread along a further portion with a larger diameter engaging the internal thread cut into the fastening hole.

The purpose of this measure is to allow a certain amount of pre-assembly of the fastening screws on the base plate that is not yet mounted on the furniture part. A further purpose of this measure is that, once the base plate is mounted on the furniture part by means of the fastening screws, slight unscrewing of the fastening screws will be enough to displace the base plate for vertical adjustment of the hinge on the furniture part.

The base plate described above is expensive and complicated in manufacturing process. It requires precisely prepared fastening holes in which the internal thread must be cut with relatively close tolerance. It also requires specially designed fastening screws, causing greater base plate costs and a larger inventory because of the special fastening screws.

It is therefore an object of the invention to develop an adjustable base plate of the type mentioned in the beginning so that it is considerably more economical to produce and will permit the use of conventional screws.

This object is achieved by the invention in that an insert is engaged in the fastening hole and can be displaced along the length of the fastening hole, and in that the fastening screw is screwed in the insert, the diameter of the collar of the fastening screw being smaller than the diameter of the center hole of the insert in the area of the fastening hole.

An essential feature of the present invention is, therefore, that an insert, made preferably of plastic, is inserted into each fastening hole, is freely displaceable along the length of the fastening hole, and receives the fastening screw. There is now no longer a need for cutting an internal thread with relatively close tolerance into the fastening hole because the insert can be displaced in the fastening hole and held in place by the elasticity of the insert that can compensate for a relatively large tolerance range of the fastening hole.

A further advantage of the invention is that conventional screws can now be used because the insert serves as a screw-locking device so that a conventional screw (such as a Spax screw) is screwed into the insert for pre-assembly and the base plate can be kept in stock in a pre-assembled condition.

There are two different designs for the insert itself. Common to both designs is an insert top part described below.

However, there is a difference between the two exemplified embodiments for the design of the insert. In the first one, the insert can be used with a Spax screw, the bottom part of the insert then having plug tenons, and the Spax screw is screwed into this bottom part so that the plug tenons cut radially into the wall of the associated hole in the furniture part.

In the second embodiment of the insert, there is only a top part, the bottom part being eliminated, and the fastening screw is designed for use with a threaded hole in the furniture part (that is, there is no plug for the insert) so that the external thread of the fastening screw directly engages the associated internal thread in the furniture part.

It is important for both embodiments that the top part of the insert has a circumferential locking lip with radially tapering shoulders. The insert is brought up from the bottom to the fastening hole for insertion into the associated fastening hole of the base plate and the tapering shoulders are pressed radially inward as the insert is pushed upward into the fastening hole until the circumferential locking lip engages the edges of the fastening hole opposite each other.

The locking groove adjacent to the locking lip in the radial direction of the insert has a height that corresponds approximately to the thickness of the material of the base plate so that, in the mounted condition, the base plate together with the fastening hole therein can be easily displaced relative to the stationary insert mounted in the furniture part.

It is preferably here for the locking groove to be followed in the axial direction by an annular shoulder with an enlarged diameter with which the insert is seated on the surface of the furniture part.

Further features of the invention are contained in the subject matter of the claims.

The subject matter of the present invention comes not only from the subject matter of the individual patent claims but also from a combination of the individual patent claims with each other.

All information and features disclosed in this document, including the summary, particularly the configuration shown in the drawings, are claimed as essential to the invention to the extent that they are new with respect to the art, viewed individually or in combination.

The invention is explained in more detail below using only one example embodiment illustrated in the drawings. The drawings and their description will indicate further features essential to the invention and other advantages of the invention.

Figure 1:
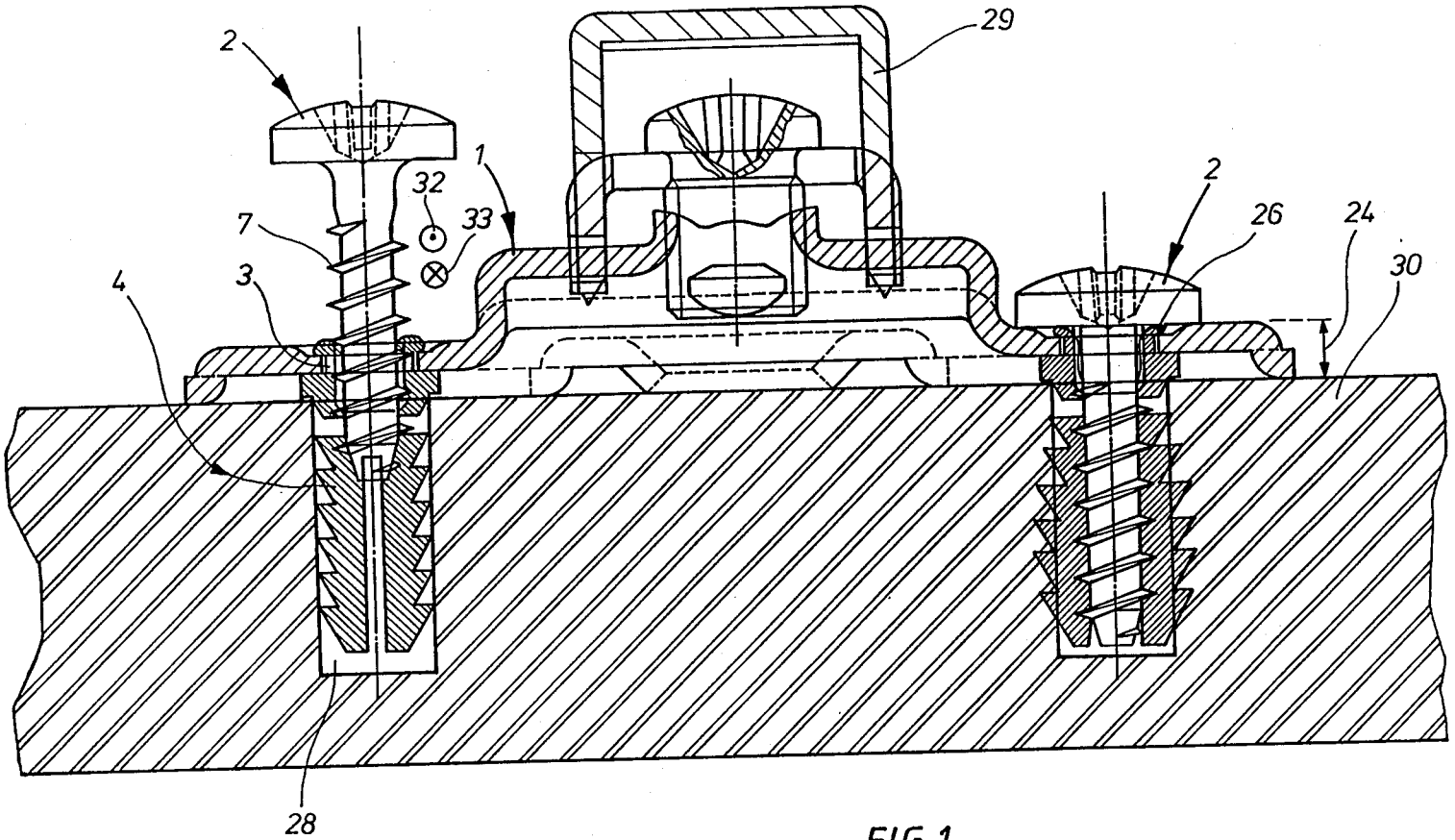
FIG. 1 is a section through a hinge with a base according to the invention with fastening screws in two different functional modes.

FIG. 1 shows one possible embodiment of a hinge, but many variations of this hinge design are possible. Only the connection of the base plate 1 with the furniture part 30 is important for the example embodiment described. In particular, the hinge arm 29 illustrated here and the other illustrated intermediate and the adjusting plates of the hinge can have completely different shapes.

The left side of FIG. 1 shows the so-called pre-assembled condition of the base plate, and it can be seen that a fastening screw 2 is screwed partway into an insert 4 and this insert 4 with its top side is engaged in the fastening hole 3 of the base plate 1. The thread 7 of the fastening screw 2 cuts into the insert 4, causing it to expand radially outward, and a vertical displacement of the base plate 1 in the arrow directions 32 and 33 is possible only with relative difficulty.

Figure 5:
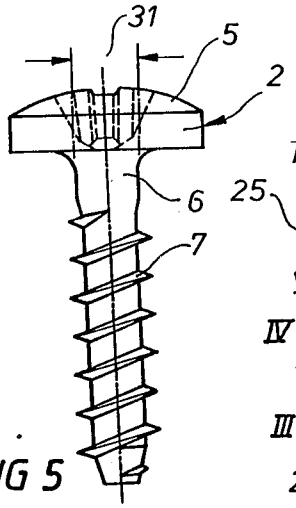
FIG. 5 is a side elevation of the fastneing screw in one possible embodiment.

The right side of FIG. 1 shows the fastening screw 2 in its mounted condition, that is, it is now screwed completely into the insert 4, and it can be seen at the same time that the top area 26 of the insert 4 that previously projected slightly over the surface of the base plate is forced down by the bottom side of the top 5 (compare FIG. 5 of the screw 2) with cold deformation of the plastic material of the insert 4 and this top area 26 is thus force-locked to the bottom side of the fastening screw 2 and thus at the same time forms a screw-locking device.

The condition for this, therefore, is that the height 25 (compare FIG. 2) of the top part 8 of the insert 4 by slightly greater than the height 24 of the base plate over the surface of the furniture part 30.

Figure 2:
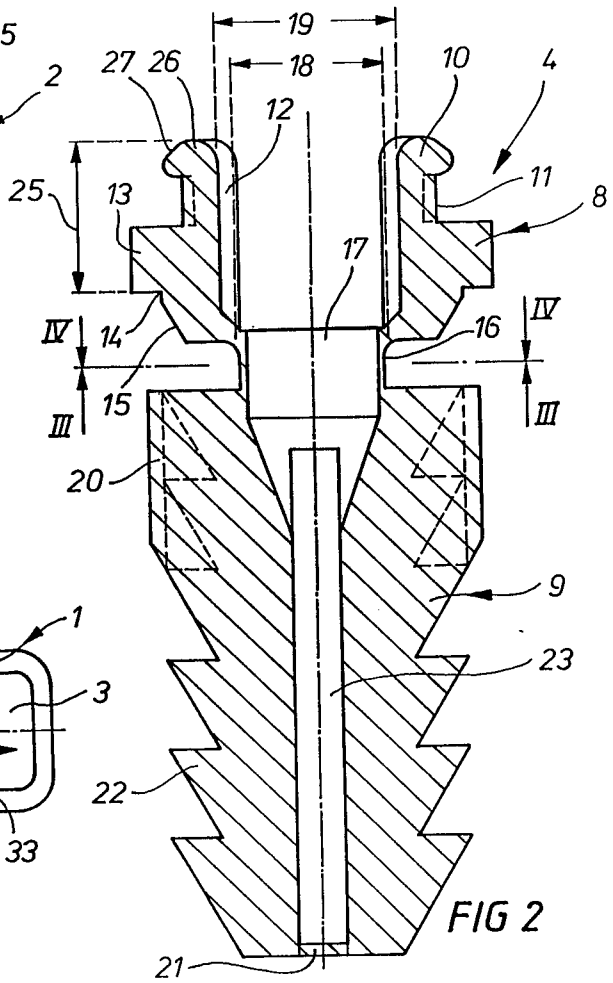
FIG. 2 is a section through the insert according to FIG. 1.
Figure 6:
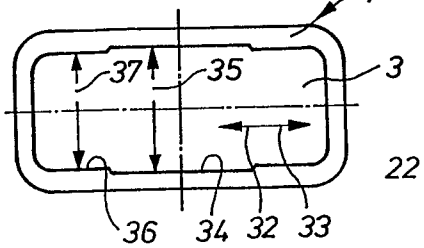
FIG. 6 is a plan view of the fastening hole of the base plate.

FIG. 2 shows other details of the shape of the top part, and it is pointed out again that the first embodiment can use an insert 4 that consists only of a top part 8, which can be inserted in the fastening hole 3 as shown in FIG. 6, the bottom part 9 being eliminated without replacement. In this embodiment, which is not shown in detail, the Spax screw illustrated in FIG. 5 would be replaced by a conventional metal screw and the hole 28 in the furniture part 30 would then be provided with a corresponding internal thread.

In the embodiment illustrated in FIG. 2, the insert 4 consists of a top part 8 connected in the axial direction by a necking 16 with the bottom part 9.

The top part 8 consists in this case of a circumferential annular locking lip 10 that has, at its top area 26, a shoulder 27 falling in the radial direction. A locking groove 11 with a reduced diameter is arranged below the shoulder.

When the falling shoulder 27 slides along the edges of the fastening hole 3 through setting of the top area 26 below the base plate and in opposition to the fastening hole, the locking lip 10 is elastically compressed and, through further pressure from the bottom on the base plate, the locking groove 11 then snaps on the edges of the fastening hole 3. The top side of the annular shoulder 13 then comes to the stop at the bottom side of the base plate 1 as illustrated in FIG. 1.

The height of the locking groove 11 corresponds approximately to the thickness of the base plate 1 in the area of the fastening hole 3 so that the entire insert 4 can be displaced relative to the fastening hole in the arrow directions 32 and 33.

In order to achieve a certain degree of centering of the insert 4 in the fastening hole 3 for pre-assembly, the fastening hole 3 is designed so that it has a center area 34 with a larger diameter 35 and outer areas 36 with a smaller diameter 37 adjacent to the center area.

The outer circumference of the locking groove 11 is selected so that there is force-locking of the locking groove 11 in the center area 34 and force-locking in the outer area 36 of the fastening hole 3. Greater resistance is to be overcome, however, in the displacement from the center area 34 into the outer area 36 because the locking lip 10 is elastically deformed.

Figure 3:
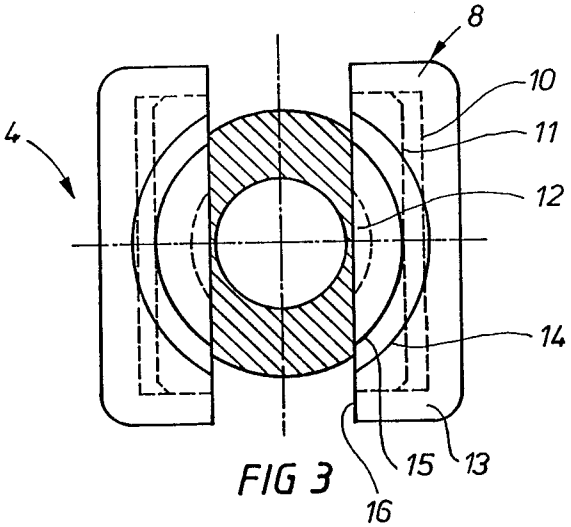
FIG. 3 is a section through the insert at the level of the III—III line in FIG. 2.

In order to achieve centering of the fastening screw 2 in the area of the center hole 17 in the top part 8, the top part 8 has recesses 12 opposite each other with a larger diameter as shown in FIG. 3 so that the fastening screw can be centered and introduced into the hole 17 for pre-assembly.

Adjacent to the bottom side of the annular shoulder 13 is a stop face 14 on which the surface of the furniture part 30 lies. Below the stop face 14 is a tapering surface 15 narrowing radially inwardly with which the insert 4 engages the hole 28 in the furniture part 30 and is centered therein.

The tapering surface 15 changes into an area with a smaller diameter that is a necking 16 as shown in FIG. 2. The diameter 18 of the necking 16 is smaller than the inside diameter 19 of the hole 17 in the area of the top part 8.

The diameter 19 of the hole 17 in the area of the top part 8 is selected, furthermore, so that it is slightly larger than the diameter 31 of the collar 6 of the fastening screw 2.

The result of this selection of the diameter ratios is that the thread 7 of the fastening screw 2 is larger than the diameter 31 in the area of the collar 6 and thus, when the fastening screw 2 is screwed into the hole 17, the turns of the thread 7 destroy the plastic material of the insert 4 in the area of the necking 16. Thus, the top part 8 is separated from the bottom part 9 when the fastening screw 2 is screwed in to the extent illustrated on the left-hand side of FIG. 1.

The separation of the top part 8 from the bottom part 9 when the fastening screw 2 is screwed in is not imperative but is considered to be a preferred embodiment of the invention and is claimed as essential to the invention.

As is known, the plug tenons 22 of the bottom part 9 do not yet take hold when the fastening screw 2 is screwed only slightly into the slot 23 of the bottom part 9 as illustrated in the left-hand side of FIG. 1. The bottom part 9 then has the tendency to wander in the hole 28 in the direction of the bottom side of the base plate 1 because the plug tenons 22 have not yet cut into the wall of the hole 28. If a separation is carried out now between the top part 8 and the bottom part 9 in the area of the necking 16, the bottom part 9 will be allowed to wander axially somewhat in the direction of the bottom side of the base plate 1 when the fastening screw 2 is screwed in without causing a lift-off motion toward the base plate 1. That is, when the fastening screw 2 is installed, there is no need for additional pressure on the base plate 1 or on the fastening screw 2 in order to hold the base plate 1 down on the furniture part 30.

Figure 4:
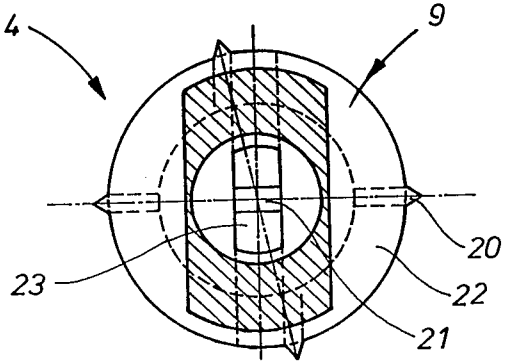
FIG. 4 is a section through the insert at the level of the IV—IV line in FIG. 2.

In order to ensure rapid engagement of the bottom part 9 with its plug tenons 22, twist safeguards 20 projecting over the plug tenons 22 are also provided on the outer circumference of the bottom part 9 as shown in FIG. 2 and FIG. 4; these axially running ribs prevent undesired twisting of the bottom part 9 in the hole 28.

The bottom part 9 also has a continuous slot 23 into which the screw 2 is then screwed, the slot being connected below through a rib 21 that is severed when the screw is screwed in completely.

If the fastening screw 2 is unscrewed slightly in accordance with the right-hand side of FIG. 1, the collar 6 with its smaller diameter 31 will be located in the area of the hole 17 with the larger diameter 19 and the base plate 1 can be easily displaced relative to the top part 8 of the insert 4 in the arrow directions 32 and 33.

When the fastening screw 2 is tightened completely, the top area 26 of the insert 4 will be deformed below the top 5 of the fastening screw 2, which is to be considered as additional protection against twisting (spring lock).

SUMMARY

The adjustable base plate is connected with a furniture part by means of fastening screws engaging associated fastening holes. The connection between the fastening screw and the base plate is to be designed so that a vertical adjustment of the base plate is readily possible when the fastening screw is unscrewed slightly and so that the fastening screws can be pre-mounted in the base plate. For this purpose, an insert is inserted into the fastening hole and can be displaced along the length of the fastening hole, the fastening screw being screwed into the insert and the diameter of the collar of the fastening screw being smaller than the diameter of the center hole of the insert in the area of the fastening hole. When an insert is used, preferably made of plastic, that is inserted into the fastening hole and that holds the fastening screw, threaded holes are no longer needed in the area of the fastening hole and conventional fastening screws can be used.

I claim:

1. An adjustable base plate for fastening a hinge to a furniture part, said base plate having at least one fastening hole therein for receiving an insert displaceable in a lengthwise direction of the fastening hole, said insert having a center hole of a pre-determined diameter with its midpoint on a longitudinal axis of the insert adapted to receive a fastening screw having a head and a section with threads remote from the head and an unthreaded collar of a pre-determined diameter between the head and the section with threads, the diameter of said collar being less than the diameter of said center hole in the area of said fastening hole.

2. An adjustable base plate as described in claim 1, said insert having a top part engaged in the fastening hole and a bottom part attached to said to part adapted to be inserted in a hole in the furniture part, said bottom part being adapted to expand into frictional engagement with the side walls of the hole in the furniture part upon insertion of said fastening screw.

3. Adjustable base plate as claimed in claim 2, said bottom part being joined to said top part by a breakable connection adapted to be broken by the threads of the fastening screw.

4. An adjustable base plate as claimed in claim 2 or 3, said base plate having an upper surface and a lower surface separated by a pre-determined thickness of the base plate, said top part of the insert having a locking groove proximate the fastening hole defined by a circumferential locking lip having radially tapering shoulder and an annular shoulder spaced from said locking lip a distance which corresponds to the thickness of the base plate, said annular shoulder being seated against the furniture part adjacent the hole in the furniture part.

5. An adjustable base plate as claimed in claim 4, said annular shoulder having a downwardly tapering surface for engaging said hole of the furniture part for centering of the insert in said hole of the furniture part.

* * * * *